US008110764B2

(12) United States Patent
Hsu et al.

(10) Patent No.: US 8,110,764 B2
(45) Date of Patent: Feb. 7, 2012

(54) KEY STRUCTURE

(75) Inventors: Chien-Shih Hsu, Taipei (TW); Liang-Ta Yeh, Shulin (TW)

(73) Assignee: Darfon Electronics Corp., Taoyuan (TW)

( * ) Notice: Subject to any disclaimer, the term of this patent is extended or adjusted under 35 U.S.C. 154(b) by 373 days.

(21) Appl. No.: 12/473,229

(22) Filed: May 27, 2009

(65) Prior Publication Data

US 2009/0294268 A1 Dec. 3, 2009

(30) Foreign Application Priority Data

Jun. 2, 2008 (TW) ..... 97120433 A

(51) Int. Cl.
*H01H 13/70* (2006.01)

(52) U.S. Cl. ..... 200/344

(58) Field of Classification Search ..... 200/344, 200/341, 314, 346, 345; 400/490–495, 472
See application file for complete search history.

(56) References Cited

U.S. PATENT DOCUMENTS

| | | | | | |
|---|---|---|---|---|---|
| 4,806,908 | A * | 2/1989 | Krupnik | 200/314 |
| 5,504,283 | A * | 4/1996 | Kako et al. | 200/344 |
| 5,901,837 | A * | 5/1999 | Aimi | 200/344 |
| 5,971,637 | A * | 10/1999 | Malhi et al. | 400/491.2 |
| 6,068,416 | A * | 5/2000 | Kumamoto et al. | 400/491 |
| 6,080,948 | A * | 6/2000 | Hong | 200/344 |
| 6,375,372 | B1 * | 4/2002 | Tsau | 400/490 |
| 6,529,370 | B1 * | 3/2003 | Kamishima | 400/490 |
| 6,753,793 | B1 * | 6/2004 | Kako et al. | 200/5 R |
| 6,781,077 | B2 * | 8/2004 | Olodort et al. | 200/344 |
| 7,022,927 | B2 * | 4/2006 | Hsu | 200/344 |
| 2004/0178051 | A1 * | 9/2004 | Sato | 200/344 |
| 2006/0000695 | A1 * | 1/2006 | Yoneyama | 200/5 A |
| 2009/0294268 | A1 * | 12/2009 | Hsu et al. | 200/345 |

* cited by examiner

*Primary Examiner* — Briggitte R Hammond

(57) ABSTRACT

A key structure is provided, including a substrate, a key cap, a first link, and a second link pivotally connected to the first link. The first and second links movably connect the key cap with the base. The key cap comprises a first surface and a guiding portion extended along a first direction, wherein the guiding portion has a second surface. The first link is made of metal and has a sliding end forming a first curved portion and a second curved portion. The first and second curved portions are respectively adjacent to the first and second surfaces and slidable along the guiding portion.

10 Claims, 5 Drawing Sheets

KEY STRUCTURE

CROSS REFERENCE TO RELATED APPLICATIONS

This application claims priority of Taiwan Patent Application No. 097120433, filed on Jun. 2, 2008, the entirety of which is incorporated by reference herein.

BACKGROUND OF THE INVENTION

1. Field of the Invention

The invention relates in general to a key structure and in particular to a key structure with a metal link.

2. Description of the Related Art

Referring to FIG. 1, a conventional key structure primarily comprises a substrate B, a key cap C, an elastic dome D, a first link L1, and a second link L2, wherein the first and second links L1 and L2 are pivotally connected to each other.

When the key cover C is depressed by an external force, the elastic dome D exerts a recovery force on the key cap C. When the external force is released, the key cover C can return to the initial position by the recovery force, as the arrows indicate in FIG. 1. However, since the first and second links L1 and L2 are usually made of plastic, robust structural strength and miniaturization of key structures are difficult to achieve.

BRIEF SUMMARY OF INVENTION

The invention provides a key structure including a substrate, a key cap, a first link, and a second link pivotally connected to the first link. The first and second links movably connect the key cap with the base. The key cap comprises a first surface and a guiding portion extended along a first direction, wherein the guiding portion has a second surface. The first link is made of metal and has a sliding end forming a first curved portion and a second curved portion. The first and second curved portions are respectively adjacent to the first and second surfaces and slidable along the guiding portion.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1:
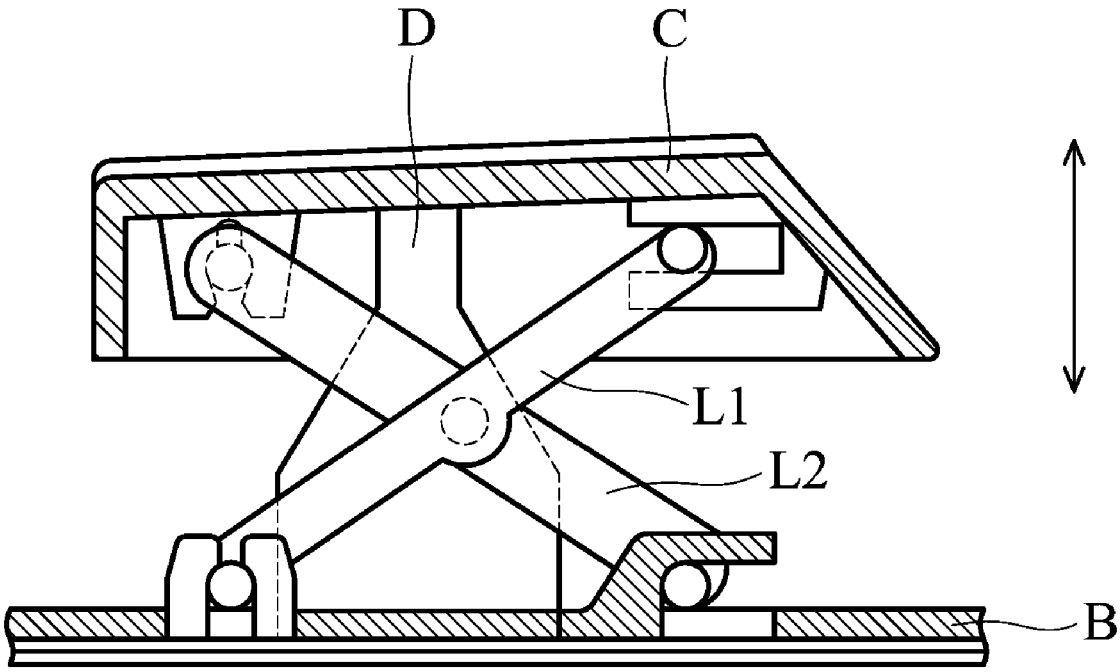
FIG. 1 ( PRIOR ART )
FIG. 1 is a perspective diagram of a conventional key structure.
Figure 2:
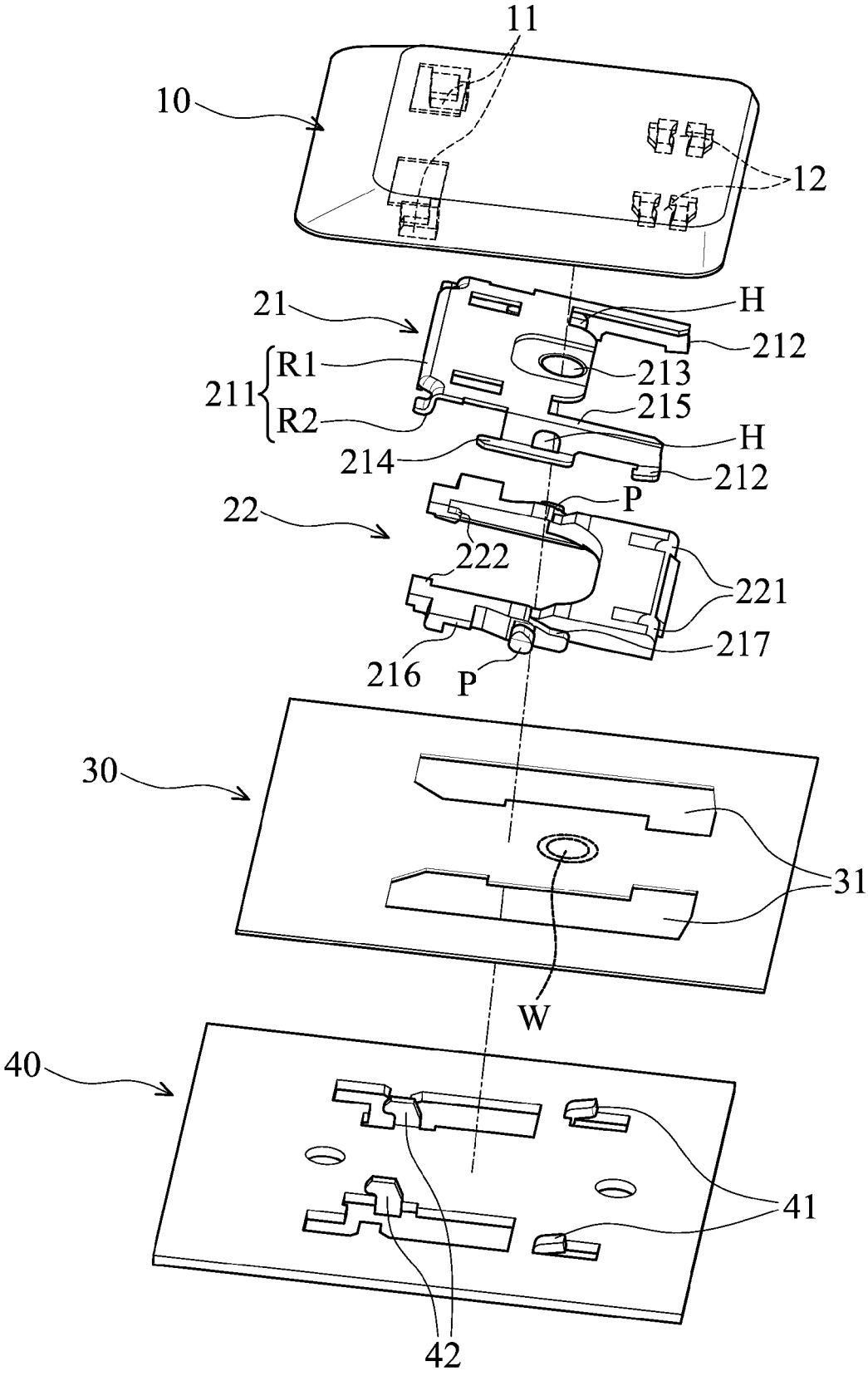
FIG. 2 is an exploded diagram of a key structure according to an embodiment of the invention.

Referring to FIG. 2, an embodiment of key structure primarily comprises a key cap 10, a first link 21, a second link 22, a circuit board 30, and a substrate 40. The first link 21 is made of metal, and the second link 22 is made of metal or plastic. The first link 21 comprises a pair of pivots P rotatably received in the holes H of the second link 22, such that the first and second links 21 and 22 are pivotally connected to each other.

As shown in FIG. 2, the first and second links 21 and 22 extend through the openings 31 of the circuit board 30 and movably connect the key cap 10 with the substrate 40. Here, a sliding end 211 of the first link 21 is movably connected to a guiding portion 11 of the key cap 10, and a connection end 221 of the second link 22 is pivotally connected to a recess 12 of the key cap 10. Additionally, the connection ends portions 212 and 222 of the first and second links 21 and 22 are movably connected to the connection portions 41 and 42, so that the key cap 10 is vertically movable via the first and second links 21 and 22.

When the key cap 10 is depressed from a first position to a second position by an external force, a contact portion 213 of the first link 21 descends and contacts a switch W on the circuit board 30 (FIG. 2). The key structure may further comprise an elastic member E disposed on the circuit board 30, such as a rubber dome or spring, which provides a recovery force to return the key cap 10 to the first position when the external force is released.

Figure 3:
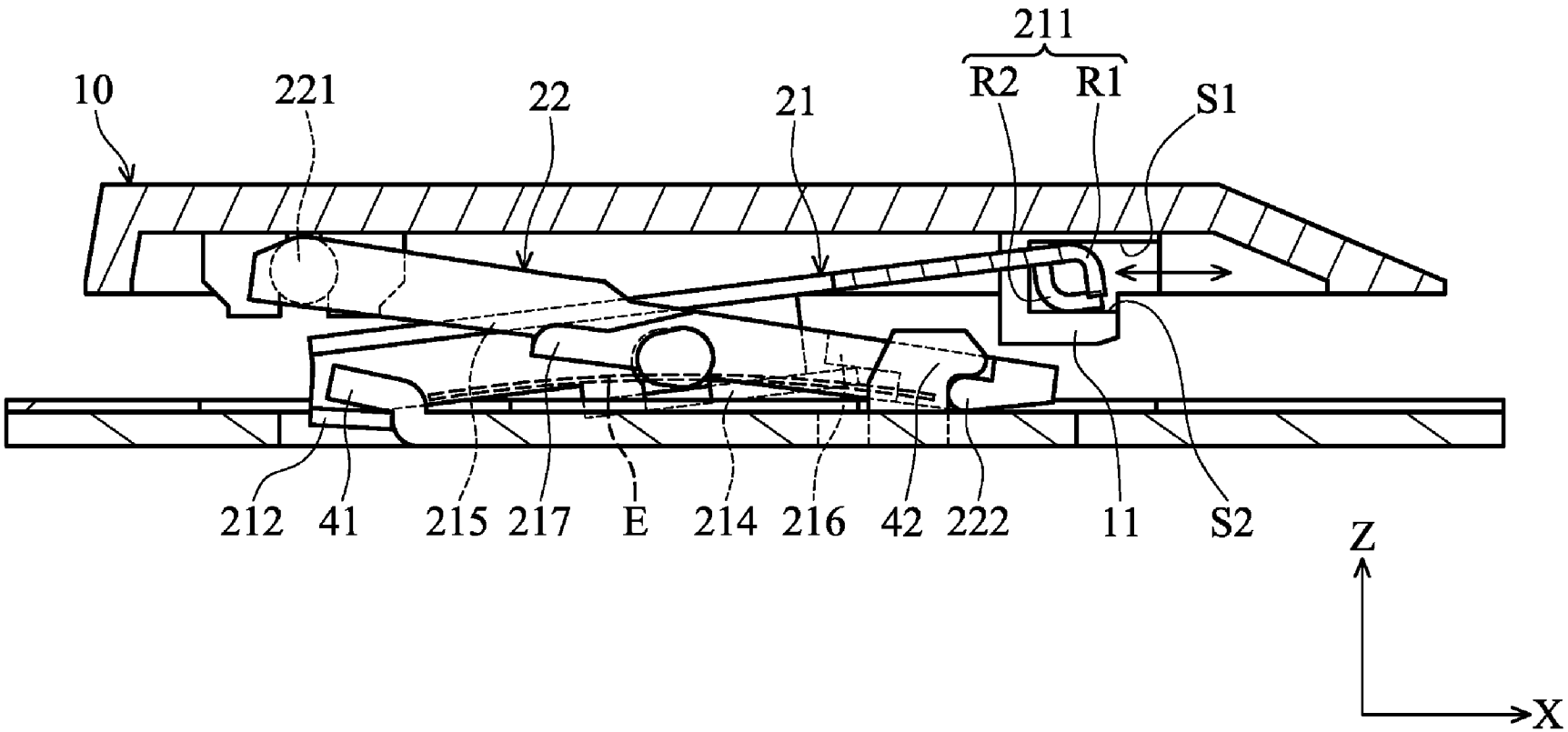
FIG. 3 is a sectional view of a key structure according to an embodiment of the invention.

Referring to FIGS. 2 and 3, the sliding end 211 of the first link 21 is bent to form a first curved portion R1 and a second curved portion R2. The first and second curved portions R1 and R2 are respectively adjacent to a first surface S1 of the key cap 10 and a second surface S2 of the guiding portion 11. When the key cap 10 vertically moves along a Z axis, the first and second curved portions R1 and R2 slide along the guiding portion 11, as the arrows indicate in FIG. 3. In this embodiment, the first and second curved portions R1 and R2 can facilitate smooth contact when sliding along the guiding portion 11.

Figure 4:
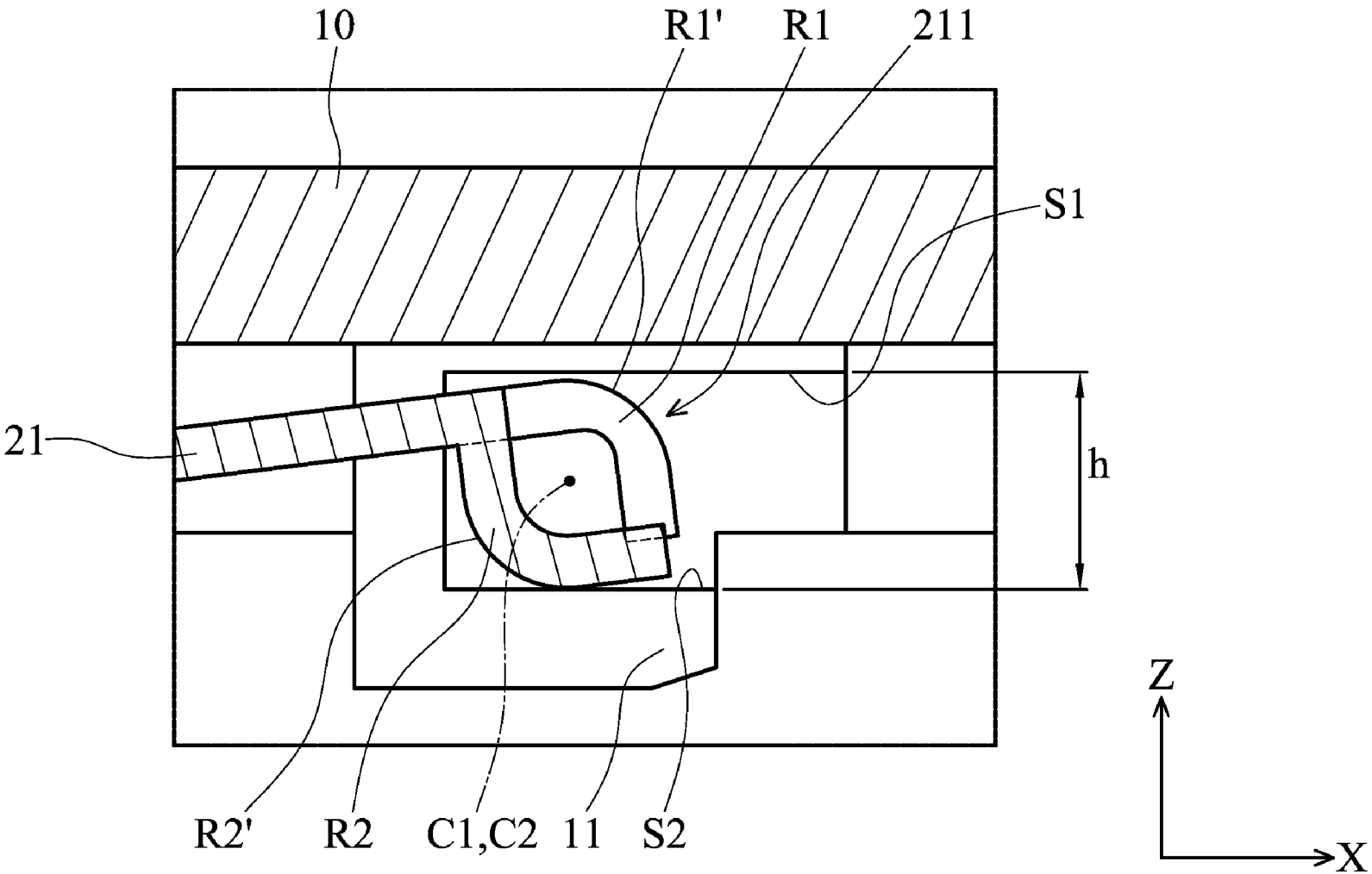
FIG. 4 is a large view of the first link and the guiding portion in FIG. 3.

Referring to FIG. 4, the guiding portion 11 is extended substantially along a first direction (X axis). Specifically, the first and second curved portions R1 and R2 have a first curved surface R1' and a second curved surface R2', wherein the first curved surface R1' defines a first curvature center C1, and the second curved surface R2' defines a second curvature center C2. In this embodiment, the first curvature center C1 substantially coincides with the second curvature center C2. As shown in FIG. 4, the first and second surfaces S1 and S2 are spaced apart a distance h, substantially equal to a maximum width of the first and second curved portions R1 and R2, such that the sliding end 211 can stably slide along the guiding portion 11.

Figure 5:
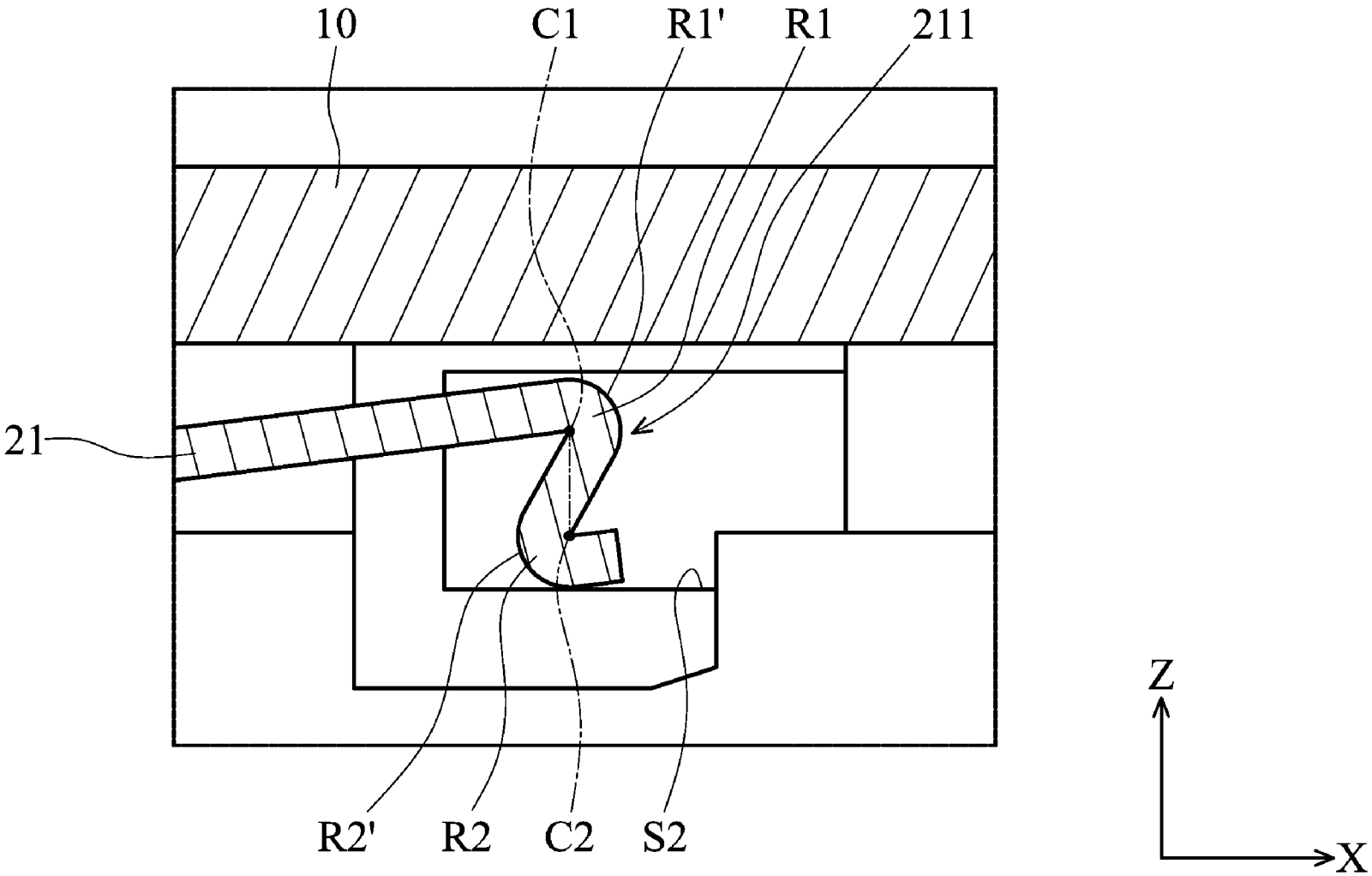
FIG. 5 is a sectional view of a key structure according to another embodiment of the invention.

Referring in FIG. 5, another embodiment of the sliding end 211 of the first link 21 is bent to form a Z-shaped configuration, wherein the first and second curved portions R1 and R2 constitute the angled structures of the Z-shaped sliding end 211. As shown in FIG. 5, the first and second curved surfaces R1' and R2' are respectively adjacent to the first and second surfaces S1 and S2. In this embodiment, the first and second curvature centers C1 and C2 are separated from each other, and a straight normal line connecting the first and second curvature centers C1 and C2 is substantially perpendicular to the X axis. However, positions of the first and second curvature centers C1 and C2 can be adjusted depending on design considerations.

As shown in FIGS. 2 and 3, the first link 21 comprises two flattened fringes 214 and 215, and the second link 22 comprises two stoppers 216 and 217 corresponding to the fringes 214 and 215. When the key cap 10 returns to the first position, the fringes 214 and 215 respectively abut the stoppers 216 and 217, so as to prohibit rotation between the first and second links 21 and 22. Thus, the key cap 10 can be restricted in the first position.

The invention provides a key structure comprising a first link movably connecting a substrate with a key cap, wherein the first link is made of metal. Compared with conventional key structures, the metal first link can provide better structural strength and facilitate miniaturization of the key structure. A sliding end of the first link is bent to form two curved portions for smooth sliding and rotation with respect to a guiding portion on an inner side of a key cap, such that the key cap is vertically movable relative to the substrate.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A key structure, comprising:

a substrate;

a circuit board, disposed on the substrate;

a key cap, comprising a first surface and a guiding portion extending along a first direction, wherein the guiding portion comprises a second surface;

a first link, connecting the key cap with the substrate, wherein the first link is made of metal and comprises a sliding end forming a first curved portion and a second curved portion, wherein the first and second curved portions are slidable along the guiding portion and respectively adjacent to the first and second surfaces, wherein the sliding end is Z-shaped and comprises two angled structures, and the first and second curved portions are formed as the two angled structures;

a second link, connecting the key cap with the substrate, wherein the second link is pivotally connected to the first link;

a switch disposed on the circuit board, wherein when the key cap is depressed from a first position to a second position by an external force, the first link contacts the switch; and an elastic member disposed on the circuit board, wherein when the external force is released, the elastic member provides a recovery force to return the key cap to the first position.

2. The key structure as claimed in claim 1, wherein the first and second surfaces are spaced apart a distance substantially equal to a maximum width of the first and second curved portions.

3. The key structure as claimed in claim 1, wherein the first link further comprises a flattened flange, and the second link comprises a stopper abutting the flattened flange to restrict the key cap in the first position.

4. The key structure as claimed in claim 1, wherein the first link further comprises a hole, and the second link comprises a pivot rotatably received in the hole.

5. The key structure as claimed in claim 1, wherein the second link comprises metal.

6. The key structure as claimed in claim 1, wherein the second link comprises plastic.

7. The key structure as claimed in claim 1, wherein the first curved portion forms a first curved surface defining a first curvature center, and the second curved portion forms a second curved surface defining a second curvature center.

8. The key structure as claimed in claim 7, wherein the first curvature center substantially coincides with the second curvature center.

9. The key structure as claimed in claim 7, wherein a straight normal line connecting the first and second curvature centers is substantially parallel to the first direction.

10. A key structure, comprising:

a substrate;

a key cap, depressed from a first position to a second position by an external force;

an elastic member, disposed between the key cap and the substrate, wherein when the external force is released, the elastic member provides a recovery force to return the key cap to the first position;

a first link, connecting the key cap with the substrate, wherein the first link comprises a flattened flange; and a second link, connecting the key cap with the substrate, wherein the second link comprises a stopper abutting the flattened flange when the key cap is in the first position, so as to restrict the key cap in the first position.

* * * * *